US006027275A

United States Patent [19]

Williams

[11] Patent Number: 6,027,275

[45] Date of Patent: Feb. 22, 2000

[54] SEAL FOR NOTEBOOK AND ALBUM RINGS

[75] Inventor: Randall Dale Williams, Cornish, N.H.

[73] Assignee: Intercraft Company, Statesville, N.C.

[21] Appl. No.: 09/108,936

[22] Filed: Jul. 1, 1998

[51] Int. Cl.[7] ..... B42F 13/00

[52] U.S. Cl. ..... 402/80 R; 29/446; 29/447; 42/70.07; 402/54; 402/68; 402/80 L; 402/80 P

[58] Field of Search ..... 402/54, 60, 68, 402/80 L, 80 P, 80 R; 29/446, 447; 42/70.07

[56] References Cited

U.S. PATENT DOCUMENTS 2,080,202 5/1937 Drake ..... 42/70.07
3,910,708 10/1975 Rohner .
4,014,124 3/1977 Oberst ..... 42/70.07
4,434,534 3/1984 Handler .

*Primary Examiner*—Andrea L. Pitts
*Assistant Examiner*—Monica Smith
*Attorney, Agent, or Firm*—Foley & Lardner

[57] ABSTRACT

A seal is provided for notebooks and albums to prevent inadvertent opening of the rings and to prevent pilferage of paper, photo album insert sheets and the like. The seal is a continuous band or overlapped loop of plastic material which is heat-shrunk over the rings. In the most preferred embodiment, the material used for the seal in spot welded, such as by ultrasonic welding, to hold it in place during the heat-shrink operation.

11 Claims, 2 Drawing Sheets

40

50
53
52
54

14
31
40
25
16
20
30
24
26
21
10
18
27
22
12

SEAL FOR NOTEBOOK AND ALBUM RINGS

Cross-References To Related Applications, If Any: None

BACKGROUND OF THE INVENTION

1. Field of the Invention

The present invention relates generally to the art of notebooks and albums, which include rings which may be opened and closed and which are adapted to hold paper, photo insert sheets and the like. In its most preferred embodiment, the present invention relates to the use of a seal for the rings to prevent inadvertent opening thereof during shipment and to prevent pilferage of the paper or insert sheets at the retail location.

2. Description of the Prior Art

It is well-known in the notebook and album art to use rings for holding punched paper, photo insert sheets and the like. When used in this patent application, the terms "notebook" and "album" are not to be taken as limiting, as a wide variety of products include such rings for holding a wide variety of sheet materials. For example, calendars, time organizers , other stationery supplies, school supplies, engineering notebooks, artist supplies and the like employ such rings.

The mechanisms by which the rings of such articles are opened and closed are also well-known and, in and of themselves, do not form part of the present invention. Some rings are made to open by merely grasping the two rings and pulling them apart, while others are more sophisticated and are arranged to be opened by pressing a tab or lever associated with a metal or plastic spline which is encountered in numerous of such products. In more simple articles, the rings may be simply attached to the plastic, paper or other material from which the final notebook or album is made.

In addition, a wide variety of shapes have evolved for such rings. The most common types of rings are mating, oppositely arranged, C-shaped rings which typically include teeth at their mating ends to engage one another when fully closed. Other types of ring systems include one C-shaped ring and one ring which is generally flat on one side. The present invention has general applicability to all such ring systems, opening mechanisms and ring shapes.

One problem encountered in the manufacture and distribution of articles employing such rings is the opening thereof during packaging, shipment and in the sales environment. It would be desirable to have a system for preventing inadvertent opening of the rings.

Another separate issue related to the manufacture, distribution and sale of articles employing such rings is the problem of pilferage. For example, it is frequently encountered that someone looking to purchase a photo album will open one album supplied with a fixed number of photo insert sheets. Replacement or additional sheets are typically sold by the manufacturers and retailers for use with such albums. By simply removing such insert sheets from another complete album set or by adding a replacement at and inserting them into the first album, a customer can effectively increase the capacity of the album without paying the cost of the extra insert sheets. The cost of such pilferage amounts to substantial dollars for the manufacturers and retailers in this industry. It would also be desirable to have a system for preventing such pilferage.

FEATURES AND SUMMARY OF THE INVENTION

It is a primary feature of the present invention to provide an inexpensive and easy to use system for preventing inadvertent ring opening in the distribution and sale of notebooks and albums.

Another primary feature of the present invention is to provide an inexpensive and easy to use seal to prevent pilferage of the sheets used with such notebooks and albums.

Another feature of the present invention is to provide a system which prevents pilferage and/or ring opening and which is readily adaptable to a variety of album and ring configurations and shapes.

Another feature of the present invention is to provide a system for adding a seal to notebooks and albums which can be accomplished on high speed assembly lines, without significantly reducing the line speed or significantly increasing manufacturing cost.

How these and other objects of the present invention are accomplished will be described in the following Detailed Description of the Preferred and Alternate Embodiment of the Invention taken in conjunction with the FIGURES. Generally, however, the features are provided by a seal for the rings of notebooks and albums which is in the form of a continuous loop, which loop may be integral or overlapped at its ends to form the loop. The preferred material for constructing the seal is a heat-shrinkable plastic, and the seal is constructed and arranged to slide easily over a ring as the first step in the installation process. An alternate, but preferred form of the invention comprises a second step of "tacking" opposing sides of the loop together in the area defined by the rings to hold the seal in place for subsequent operations. The tack may be performed by welding, such as by welding, most preferable ultrasonic welding. The seal is then constricted over the ring, preferably by heat-shrinking using a heated air flow or a hot environment which causes the seal material to shrink. In the most preferred form of the invention, the seal surrounds an arc of at least one ring in the notebook or album so that when it is in its constricted condition, it cannot be easily removed without cutting the plastic material. Other ways in which the features of the invention are accomplished will become apparent to those skilled in the art after they have read the following detailed description, and such other ways are deemed to fall within the scope of the present invention if they fall within the scope of the claims which follow.

DETAILED DESCRIPTION OF THE DRAWINGS

In the following drawings, like reference numerals are used to describe like components.

DETAILED DESCRIPTION OF THE PREFERRED AND ALTERNATE EMBODIMENT

Figures 1, 2, 3:
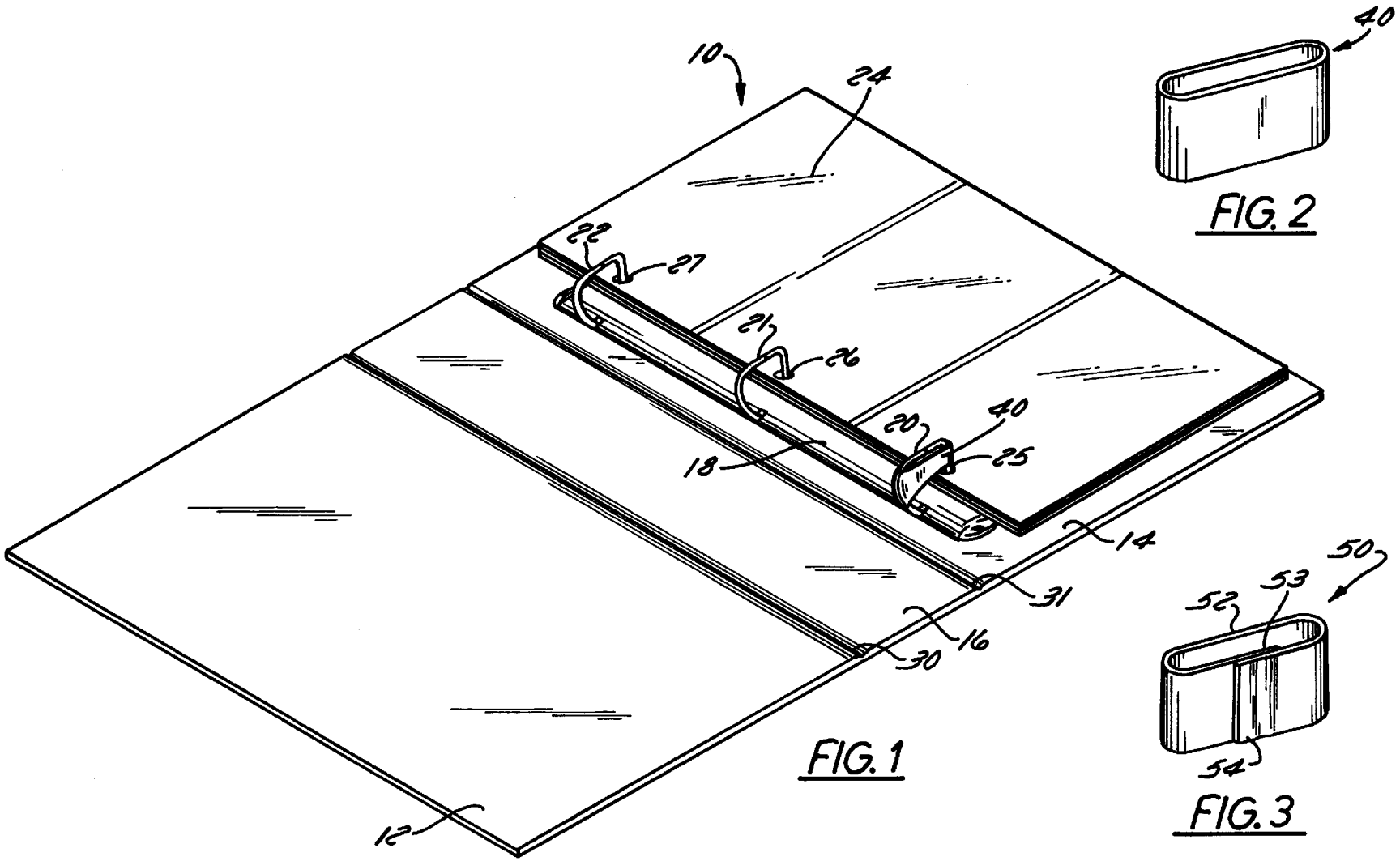
FIG. 1 is a simplified perspective view of a typical album with which the seal of the present invention may be employed, such album including two rings.
FIG. 2 is a perspective view of a first band which may be used for the seal of the present invention, i.e. an integral circular band.
FIG. 3 is a perspective view of an alternate band prepared from an overlapped strip of seal material.

Before proceeding to the Detailed Description of the Preferred and Alternate Embodiment of the present invention, several generally comments can be made about the applicability and scope of the present invention.

First, the material used for the bands illustrated in the drawings is preferably PVC (polyvinylchloride) and is the same material which is currently used in the pharmaceutical and food industries for providing tamper-resistant closure of products.

Second, the particular width of the band is not critical to the present invention, but in the illustrations, a band which is substantially wider than it is thick is employed. Such a configuration facilitates rapid heat shrinking and prevents a customer from readily breaking or tearing the seal for purposes previously discussed.

Figure 4:
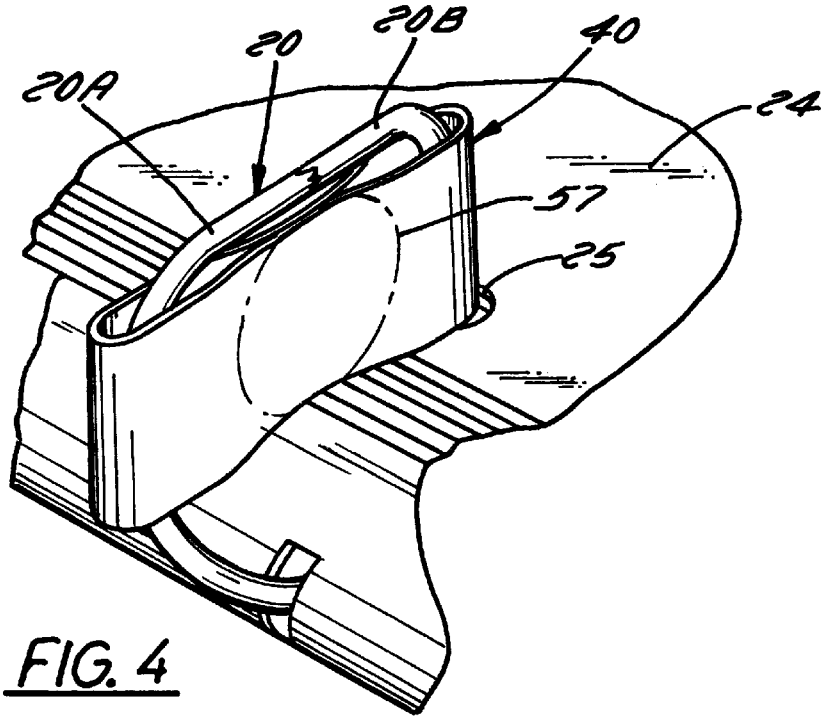
FIG. 4 is a perspective view of one of the rings shown in FIG. 1, with the band of FIG. 2 deployed thereover and a spot weld having been formed therein.

Third, tack weld, such as by ultrasonic welding, which is disclosed in connection with FIG. 4, provides one technique for holding the band in place over the ring while heat shrinking step take place. Other techniques for holding the band in place could be employed, such as the use of adhesives, stapling and the like.

Fourth, the illustrations show one popular form of ring configuration, but as mentioned above, the shape of the rings, the number thereof and the way in which such rings are opened do not, in and of themselves, form part of the present invention. The invention may be widely adapted to a variety of notebook and album configurations and to a wide variety of ring shapes.

Finally, the particular materials from which the rings and bands are formed are not critical as long as they perform the functions required thereof in the following description. For example, while the rings are typically made of metal, plastics may be employed, and while PVC is the preferred plastic material for forming the band, other types of plastics, foils and the like may be employed.

Proceeding now to a description of FIG. 1, an album 10 with which the present invention may be employed, includes front cover 12, back cover 14 and a spline 16. A metal support 18 extends the length of the spline and three rings 20, 21 and 22 are illustrated. Moreover, a sheet of material, in this case a photo album insert sheet, is deployed over the rings, the sheet 24 having holes 25, 26 and 27 matching with rings 20–22 as is well-know. The front and back cover pivot around creases 30 and 31 as is also well-know.

Proceeding next to FIG. 2, a continuous band 40, preferably made of heat-shrinkable PVC, is illustrated. Note in this FIGURE that the band is continuous, i.e. it does not include any seams around its circumference.

Band 40 has a width which is substantially greater than the thickness of the material from which it is made. The band may be prepared from extruded tubes of the starting material or using any other band forming technique known to the art.

FIG. 3 shows an alternate embodiment of a band 50 which is made from an elongate strip 52 of material similar or identical to that used in the FIG. 2 embodiment. The strip 52 has a first end 53, a second end 54, ends 53 and 54 being overlapped and suitably attached to one another by adhesive, heat welding or any other suitable technique to form a continuous loop.

FIG. 4 illustrates the combination of the FIG. 2 band with ring 20 shown in FIG. 1. Note that the band is somewhat loose around the ring to facilitate the ready deployment of the band 40 over ring 20, for example by using banding equipment available in the art. Such banding equipment is known and widely used in the food and pharmaceutical industries. FIG. 4 also illustrates that an area 57 of band 40 has been adhered to a conforming opposite side of band 40, such as by heat welding. The heat welding is indicated by the circular area 57 in this FIGURE, an area within the two halves 20A and 20B of ring 20. It will be apparent at this point that when such an attachment is made, the band 40 may not readily be removed from ring 20 when the halves 20A and 20B are in their closed position.

The heat weld can be made using a jaw-like device which clamps over the band, forcing the two halves together under ultrasonic welding or other heat welding conditions until a material flow occurs to bond the two sides of band 40 to one another. The area of the weld is also not critical with respect to the area of the rings 57 in FIG. 4. It can also be noted in FIG. 4 that the band extends about an arc of ring half 20A and along the flat side of ring half 20B in such a manner that removal of the band would become even more difficult if the band were constricted from its position as illustrated in FIG. 4.

Figure 5:
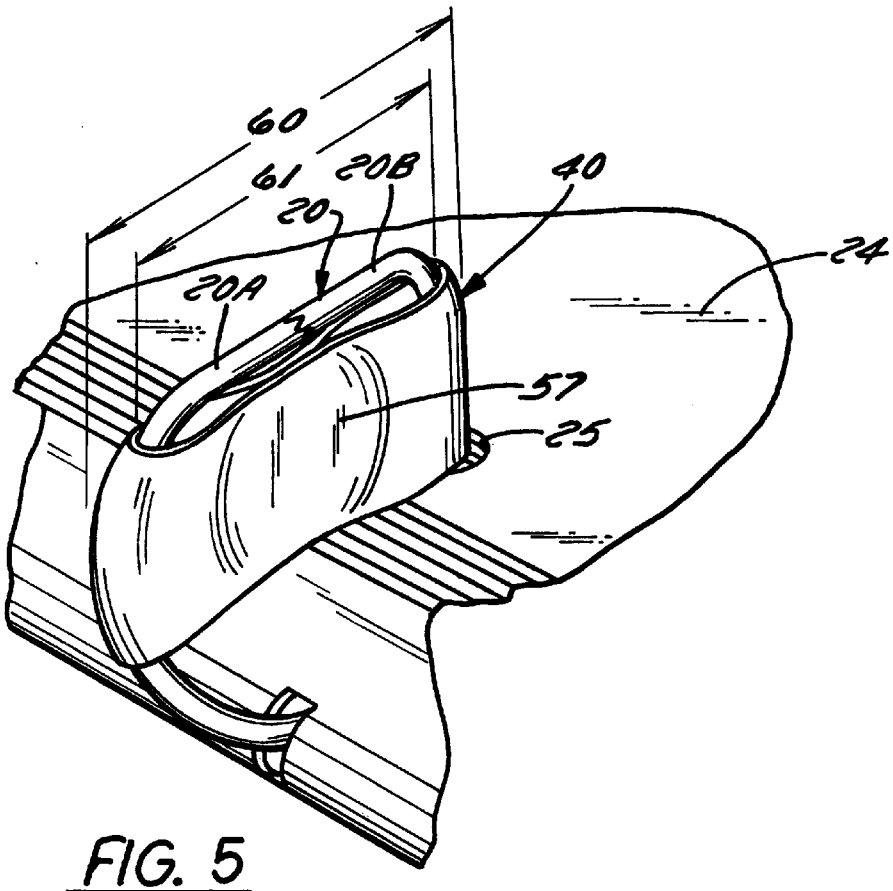
FIG. 5 is a perspective view of the same ring shown in FIG. 4, with the band of FIG. 2 in its constricted condition and capturing the ring to prevent inadvertent opening and/or sheet pilferage.

The constricted position of band 40 is illustrated clearly in FIG. 5 where a heat shrinking operation has occurred to tightly confine ring halves 20A and 20B within band 40. Note specifically the distances marked by distance lines 60 and 61 and the fact that line 60 is longer than line 61. The seal 40 cannot be readily removed from the ring, except by using scissors, a knife or another implement not typically available to a consumer examining the product for purchase.

Heat sealing can be readily accomplished using a focused flow of heated air or by passing the ring and bands through an environment which is warm enough to cause the plastic to constrict. The selection of appropriate heating times and temperatures are within the bounds of routine experimentation, depending upon the size of the ring, the thickness of the band material and the like. Preferably, the time and temperature should be selected so that they do not interfere substantially with the normal speed of assembly of albums 10 or have deleterious effects on the materials used to construct albums 10.

While the foregoing invention has been described in connection with a particular preferred embodiment, that embodiment should not be taken as limiting. The invention should be considered limited only by the scope of the claims which follow.

What is claimed is:

1. A seal system for an album or notebook comprising:

an album or notebook including at least two rings, each of which has first and second sides, the sides being movable from a first closed position to a second open position to permit insertion or removal of sheets; and a separate loop deployed snugly about each of the rings when the sides are in their closed position, the loops preventing movement of the sides to their open position without destruction of the loops.

2. The seal system of claim 1 wherein each loop is a continuous band of heat shrinkable plastic.

3. The seal system of claim 1 wherein each loop is constructed from a strip of heat shrinkable plastic having first and second ends, the first and second ends being overlapped and attached to form a loop.

4. The seal system of claim 1 wherein each loop is welded to itself intermediate the ring sides.

5. The seal system of claim 4 wherein the weld is an ultrasonic weld.

6. The seal system of claim 1 wherein each loop is a band having a width substantially greater than its thickness.

7. A method of sealing a ring of an album or notebook, the ring having first and second sides being moveable from a first closed position to a second open position to permit insertion or removal of sheets, the method comprising the steps of:

placing a loop loosely about the ring, and constricting the loop to prevent movement of the sides to their open position without destruction of the loop.

8. The method of claim 7 wherein the loop is a continuous band of heat shrinkable plastic and the constricting step comprises heating the loop.

9. The method of claim 7 wherein the loop is constructed from a strip of heat shrinkable plastic having first and second ends, and the method comprises the step of overlapping the first and second ends and attaching them to each other to form a loop.

10. The method of claim 7 comprising the additional step of welding the loop to itself intermediate the ring sides, said additional step occurring between the placing and constricting steps.

11. The method of claim 7 wherein the welding step comprises ultrasonically welding the loop to itself intermediate the ring sides.

* * * * *